United States Patent [19]

Yarrow

[11] Patent Number: 5,031,946

[45] Date of Patent: Jul. 16, 1991

[54] DOOR REINFORCING APPARATUS

[76] Inventor: Frederick J. Yarrow, Stateline Precision Engineering, Unit 37, New Lydenburg Industrial Estate, New Lydenburg Street, Charlton, London, SE7, England

[21] Appl. No.: 590,480

[22] Filed: Sep. 28, 1990

[51] Int. Cl.[5] ..... E05C 21/00

[52] U.S. Cl. ..... 292/337; 292/340; 292/DIG. 53; 49/462

[58] Field of Search ..... 70/416, 418; 292/346, 292/337, 340, DIG. 53; 49/462; 403/282

[56] References Cited

U.S. PATENT DOCUMENTS

| | | | |
|---|---|---|---|
| 1,814,961 | 7/1931 | Phillips | 292/346 |
| 4,118,134 | 10/1978 | Mansel | 403/282 |
| 4,139,999 | 2/1979 | Allenbaugh | 292/337 |
| 4,186,954 | 2/1980 | Detlefs | 292/340 |
| 4,474,394 | 10/1984 | Crepinsek | 292/340 X |
| 4,887,856 | 12/1989 | Percoco et al. | 292/337 |

*Primary Examiner*—Richard E. Moore
*Attorney, Agent, or Firm*—Iandiorio & Dingman

[57] ABSTRACT

Door reinforcing apparatus (2) comprising a lock guard (4) for fitting to an outer face (10) of a door (12) adjacent a lock (14) in the door (12), and fixing studs (18) for fixing the lock guard (4) in position, the lock guard (4) being larger than the lock (14), the lock guard (4) having a side wall (20) which extends over the outer face (10) of the door (12) and an end wall (22) which abuts the edge (24) of the door (12) during use of the door reinforcing apparatus (2), the side wall (20) having a key aperture (26) for receiving a key for the lock (14), the end wall (22) having a lock aperture (30) for receiving at least a bolt part of the lock (14) so that the bolt part of the lock (14) can pass backwards and forwards through the lock aperture (30) during operation of the lock (14), and the fixing studs (18) comprising studs (40) which extend from an inner face (42) of the side wall (20) of the lock guard (4) parallel to but spaced apart from the end wall (22), and screw members (44) which pass through apertures (26) in the end wall (22) and which screw into screw threaded apertures (48) in the studs (40), and the fixing studs (18) being such that the studs (40) are not visible from an outer face (50) of the side wall (20) and the screw members (44) are only visible on the end wall (22).

9 Claims, 2 Drawing Sheets

DOOR REINFORCING APPARATUS

This invention relates to door reinforcing apparatus.

It is well known that doors can be locked with either mortise locks or yale locks. Sometimes the doors are provided with a mortise lock and also with a yale lock. Irrespective of the type or types of locks employed, there is an increasing trend for burglars to force their way into an establishment by kicking or charging at the door until the wood of the door surrounding the lock or locks splinters and breaks. It is known to provide door reinforcing apparatus which is able to reinforce the lock part of a door but the known door reinforcing apparatus is often difficult to fit and/or unsightly to look at.

It is an aim of the present invention to obviate or reduce the above mentioned problems.

Accordingly, this invention provides door reinforcing apparatus comprising a lock guard for fitting to an outer face of a door adjacent a lock in the door, and fixing means for fixing the lock guard in position, the lock guard being larger than the lock, the lock guard having a side wall which extends over the outer face of the door and an end wall which abuts the edge of the door during use of the door reinforcing apparatus, the side wall having a key aperture for receiving a key for the lock, the end wall having a lock aperture for receiving at least a bolt part of the lock so that the bolt part of the lock can pass backwards and forwards through the lock aperture during operation of the lock, and the fixing means comprising studs which extend from an inner face of the side wall of the lock guard parallel to but spaced apart from the end wall, and screw members which pass through apertures in the end wall and which screw into screw threaded apertures in the studs, and the fixing means being such that the studs are not visible from an outer face of the side walls and the screw members are only visible on the end wall.

When the door reinforcing apparatus of the present invention is in use on a door and the door is closed, then the fixing means will not be visible. All that will be visible will be the outer face of the side wall of the lock guard and this outer face can be arranged to look aesthetically pleasing. In addition to the door reinforcing apparatus thus looking neat and pleasing, it will be apparent that burglars will not be able to see from the outside where the fixing means are located. This helps to prevent burglars trying to hit at the door reinforcing apparatus to break it. Because the lock guard fits only on the outer face of the door and the edge of the door, it will be apparent that the lock guard can be used with both mortice and yale locks. When fitted to a door, the door reinforcing apparatus will be held securely in position because the studs and the screw members will be extending through the door at right angles to each other and both the studs and the screw members can be arranged to extend deep into the door. For example, with a door that is 1¾ inches thick, the studs can be arranged to be 1½ inches long. Attempts to force a door provided with the door reinforcing apparatus will usually only result in causing the studs and/or the screw members to bind more and more into the material of the door, which will usually be wood.

The door reinforcing apparatus of the present invention is especially useful for expensive doors which may be made of, for example, of wood or a wood veneer. With such expensive doors, it is often not desirable to have door reinforcing apparatus with fixing means which shows from the outside of the door. With the door reinforcing apparatus of the present invention, the outer face of the side wall can be arranged to be substantially plain or provided with an appropriate design but, in either case, the outer face of the side wall can be arranged to blend aesthetically with the rest of the door. Thus, in addition to being provided on the front doors of houses, offices and factories, the door reinforcing apparatus of the present invention can also be used on internal doors where security may be required, for example the internal doors of boardrooms in factories or the internal doors of courtrooms in Courts.

Preferably, the door reinforcing apparatus is one in which the lock guard is such that the inside wall has two of the key apertures and the end wall has two of the lock apertures. The door reinforcing apparatus can then be used with doors that have two locks, as is often favoured for additional security.

The or each lock aperture may be for receiving the entire lock in the case of a mortise lock. In this case, the or each aperture is preferably rebated so that the lock fits flush with the end wall but does not extend completely through the end wall. This provides an extra safety feature in that force applied to the door cannot then pull the lock through the lock guard.

Preferably, the studs are a press fit in recesses in the inner face of the side wall. The studs may each be provided with a knurled end for fitting in the recesses in the inner face of the side walls. Other methods of securing the studs to the inner face of the side walls may be utilised, for example welding. Generally the method of fixing the studs to the inner face of the side walls will be such that the studs are not visible from the outer face of the side walls.

The door reinforcing apparatus may include a frame guard for fitting to a door jamb, the frame guard having a front wall with a lock keeper aperture for receiving the lock bolt, and fastener apertures for receiving fastener means for securing the frame guard to the door jamb.

The fastener means for the frame guard may be screws for screwing into the door jamb.

The door reinforcing apparatus may also include a hinge guard for fitting to an outer face of the door over a hinge about which the door opens and shuts, and fixing means for fixing the hinge guard to the door, the hinge guard being larger than the hinge, the hinge guard having a side wall which extends over the outer face of the door and an end wall which abuts an edge of the door to which the hinge is fitted during use of the hinge guard, and fixing means comprising studs which extend from an inner face of the side wall of the hinge guard parallel to the end wall but spaced apart from the end wall, and screw members which pass through apertures in the end wall and which screw into screw threaded apertures in the studs, and the fixing means being such that the studs are not visible from an outer face of the side wall, and the screw members are only visible on the end wall.

The fixing means for the hinge guard may be of the same type of construction as the fixing means for the lock guard.

Preferably, the lock guard, the frame guard and the hinge guard are made from aluminium which has been plated with brass. Other materials may however be employed. A painted finish may be employed as an alternative to a plated finish.

An embodiment of the invention will now be described solely by way of example and with reference to the accompanying drawings in which.

Figure 1:
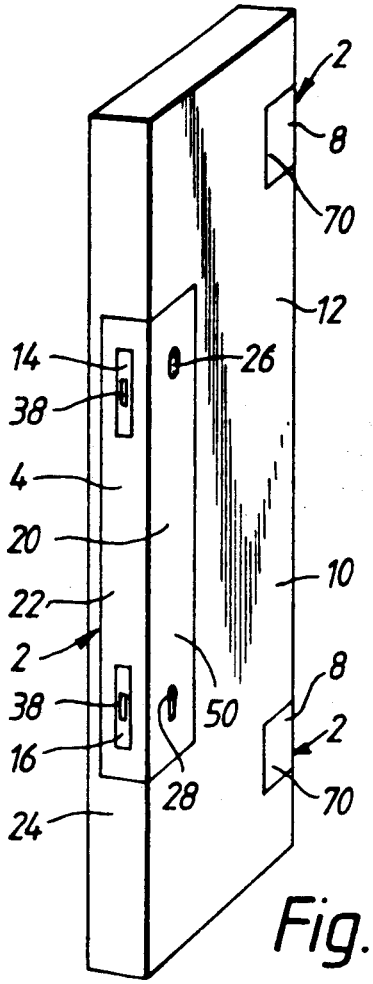
FIG. 1 is a perspective view of a door fitted with a door reinforcing apparatus.

Referring to the drawings, there is shown door reinforcing apparatus 2 comprising a lock guard 4, a frame guard 6 and a hinge guard 8.

The lock guard 4 is for fitting to an outer face 10 of a door 12 adjacent a first lock 14 and a second lock 16 in the door 12. Fixing means 18 are provided for fixing the lock guard 4 in position.

Figure 3:
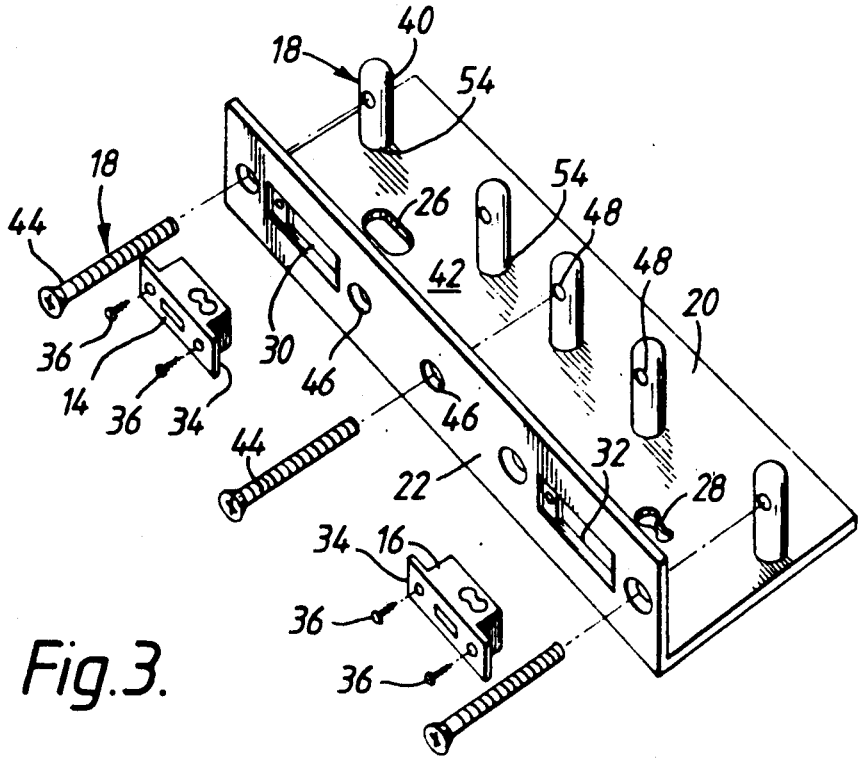
FIG. 3 is a perspective view of a lock guard forming part of the door reinforcing apparatus.

The lock guard 4 is larger than the first lock 14 and the second lock 16 as can be seen most clearly from FIG. 3. The lock guard 4 has a side wall 20 which extends over the outer face 10 of the door 12. The lock guard 4 also has an end wall 22 which abuts the edge 24 of the door 12 during use of the door reinforcing apparatus 2.

The side wall 20 has a first key aperture 26 for the first lock 14 and a second key aperture 28 for the second lock 16. The first key aperture 26 and the second key aperture 28 are for receiving keys for the first lock 14 and the second lock 16 respectively.

The end wall 22 has a first lock aperture 30 for the first lock 14, and a second lock aperture 32 for the second lock 16. The first and the second lock apertures 30, 32 are rebated so that the flange part 34 of the first and second locks 14, 16 sits in the rebate and is held therein by screws 36. The first and the second locks 14, 16 thus cannot be pulled completely through the first and the second lock apertures 30, 32 if a criminal is attempting to break down the door 12 by kicking or charging the door 12 or by using chisels or other tools on the door 12. As the first and the second locks 14, 16 are locked, a bolt part 38 of the lock will pass through the first and the second lock apertures 30, 32 and into the frame guard 6 as will be described in more detail hereinbelow.

The fixing means 18 comprises five studs 40 which extend from an inner face 42 of the side wall 20 of the lock guard 4 parallel to the end wall 22 but spaced apart from the end wall 22.

The fixing means 18 also comprises screw members in the form of screws 44 which pass through apertures 26 in the end wall 22 and which screw into screw threaded apertures 48 in the studs 40. The screw threaded apertures 48 are formed as blind screw threaded bores so that the screws 44 do not extend through the far side of the studs 40 as can best be seen from FIG. 2.

Figure 2:
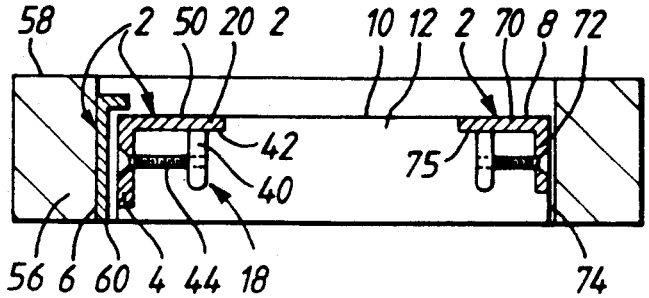
FIG. 2 is a top cross section through the door shown in FIG. 1.

The fixing means 18 is such that the studs 40 are not visible from an outer face 50 of the side wall 20. Also, the screws 44 are only visible on the end wall 22. Thus, in the closed position of the door 12 as shown in FIG. 2, it will be apparent that the fixing means 18 is not visible. All that can be seen is the outer face 50 of the side wall 20 of the lock guard 4 and this can be made to be aesthetically pleasing and such that it complements the door 12.

Figure 6:
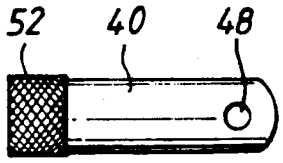
FIG. 6 is a side view of a stud as used in the lock guard shown in FIG. 3 and the hinge guard shown in FIG. 5.

The studs 40 are provided with a knurled end 52 as shown most clearly in FIG. 6. The knurled end 52 of the studs 40 are then press fitted into blind bores 54 formed in the inner face 42 of the side wall 20 of the lock guard 4. The bores 54 do not extend completely through the side wall 20 so that the bores are not visible from the outer face 50. The knurling on the knurled end 52 helps to retain the studs 40 in the bores 54. When the screws 44 are located in the screw threaded apertures 48, it will then be apparent that the studs 40 are held at their bottoms and their tops and that they will be buried in the wood or other material of the door 12. Thus, a very secure fitting is afforded.

The frame guard 6 is for fitting to a door jamb 56 forming part of a door frame 58 as shown in FIG. 2.

Figure 4:
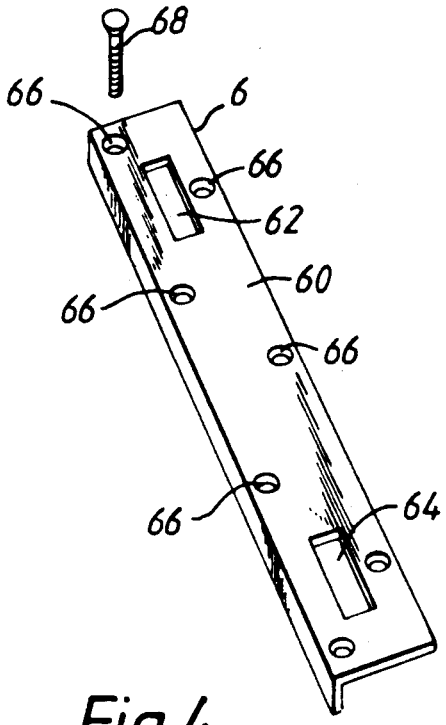
FIG. 4 is a perspective view of a frame guard forming part of the door reinforcing apparatus.

The frame guard 6 is best seen in FIG. 4. The frame guard 6 thus has a front wall 60 which is provided with a pair of lock keeper apertures 62, 64 for receiving the bolt part 38 of the first lock 14 and the second lock 16. The frame guard 6 also has fastener apertures 66 for receiving fastener means in the form of screws 68 for securing the frame guard 6 to the door jamb 56 as shown in FIG. 2.

Figure 5:
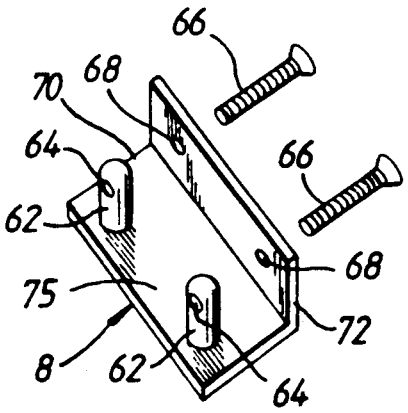
FIG. 5 is a perspective view of a hinge guard forming part of the door reinforcing apparatus.

The hinge guard 8 which is shown in detail in FIG. 5 is for fitting to the outer face 10 of the door 12 as shown in FIG. 1. The hinge guard 8 fits over hinges (not shown) about which the door 12 opens and shuts. The hinge guard includes fixing means in the form of studs 62, screw threaded apertures 64 in the studs 62, screws 66 and apertures 68. Thus the fixing means for fixing the hinge guard 8 in position is of the same construction as the fixing means 18 for fixing the lock guard 4 in position.

As can be seen from FIGS. 1 and 5, the hinge guard 8 is larger than the hinges and the hinge guard 8 has a side wall 70 which extends over the outer face 10 of the door 12. The hinge guard 8 also has an end wall 72 (see FIGS. 2 and 5) which abuts an edge 74 of the door 12 to which the hinges are fitted during use of the hinge guard 8. The studs 62 extend from an inner face 75 of the side wall 70 of the hinge guard 8. The studs 62 expand parallel to the end wall 72 but they are spaced apart from the end wall 72 as can best be seen from FIG. 5. The screws 66 pass through the apertures 68 in the end wall 72 prior to locating in the screw threaded apertures 64 in the studs 62. Thus the fixing means for the hinge guards 8 is also invisible when the hinge guards 8 are in use and the door 12 is closed. In the closed position of the door 12 as shown in FIG. 2, it will be seen that only the side wall 70 will be visible and that the studs 62 will not be visible because they do not extend completely through the side wall 70. The studs 62 are provided with knurled portions and they fit in position exactly as described above for the studs 40. Even when the door 12 is opened, only the heads of the screws 66 will be visible as the fixing means.

It is to be appreciated that the embodiment of the invention described above with reference to the accompanying drawings has been given by way of example only and that modifications may be effected. Thus, for example, the screw threaded apertures 48 could go right through the studs 40 and the screw threaded apertures 64 could go right through the studs 62. Also, the studs 40,62 could be secured in position by welds or other means if desired. Also, different types of locks than the illustrated locks 14,16 may be employed and the lock guard 4, the frame guard 6 and the hinge guard 8 can all be made in different sizes and dimensions than shown in the drawings. If desired, the lock guard 4 can be provided for a single lock instead of the illustrated two locks 14,16.

I claim:

1. Door reinforcing apparatus comprising a lock guard for fitting to an outer face of a door adjacent a lock in the door, and fixing means for fixing the lock guard in position, the lock guard being larger than the lock, the lock guard having a side wall which extends over the outer face of the door and an end wall which abuts the edge of the door during use of the door reinforcing apparatus, the side wall having a key aperture for receiving a key for the lock, the end wall having a lock aperture for receiving at least a bolt part of the lock so that the bolt part of the lock can pass backwards and forwards through the lock aperture during operation of the lock, and the fixing means comprising studs which extend from an inner face of the side wall of the lock guard parallel to but spaced apart from the end wall, and screw members which pass through apertures in the end wall and which screw into screw threaded apertures in the studs, and the fixing means being such that the studs are not visible from an outer face of the side wall and the screw members are only visible on the end wall.

2. Door reinforcing apparatus according to claim 1 in which the lock guard is such that the inside wall has two of the key apertures and the end wall has two of the lock apertures.

3. Door reinforcing apparatus according to claim 1 in which the or each lock aperture is for receiving the entire lock in the case of a mortise lock.

4. Door reinforcing apparatus according to claim 1 in which the studs are a press fit in recesses in the inner face of the side wall.

5. Door reinforcing apparatus according to claim 4 in which the studs are each provided with a knurled end for fitting in the recesses in the inner face of the side walls.

6. Door reinforcing apparatus according to claim 1 and including a frame guard for fitting to a door jamb, the frame guard having a front wall with a lock keeper aperture for receiving the lock bolt, and fastener apertures for receiving fastener means for securing the frame guard to the door jamb.

7. Door reinforcing apparatus according to claim 6 in which the fastener means for the frame guard are screws for screwing into the door jamb.

8. Door reinforcing apparatus according to claim 1 and including a hinge guard for fitting to an outer face of the door over a hinge about which the door opens and shuts, and fixing means for fixing the hinge guard to the door, the hinge guard being larger than the hinge, the hinge guard having a side wall which extends over the outer face of the door and an end wall which abuts an edge of the door to which the hinge is fitted during use of the hinge guard, and fixing means comprising studs which extend from an inner face of the side wall of the hinge guard parallel to the end wall but spaced apart from the end wall, and screw members which pass through apertures in the end wall and which screw into screw threaded apertures in the studs, and the fixing means being such that the studs are not visible from an outer face of the side wall, and the screw members are only visible on the end wall.

9. Door reinforcing apparatus according to claims 6 and 8 in which the fixing means for the hinge guard is of the same type of construction as the fixing means for the lock guard.

* * * * *